US007455427B1

(12) United States Patent
Freeman

(10) Patent No.: US 7,455,427 B1
(45) Date of Patent: Nov. 25, 2008

(54) LIGHTED TENT APPARATUS AND SYSTEM

(76) Inventor: Paul Freeman, 455 Friars Head Dr., Suwannee, GA (US) 30024

( * ) Notice: Subject to any disclaimer, the term of this patent is extended or adjusted under 35 U.S.C. 154(b) by 0 days.

(21) Appl. No.: 11/475,822

(22) Filed: Jun. 27, 2006

Related U.S. Application Data

(60) Provisional application No. 60/693,917, filed on Jun. 27, 2005.

(51) Int. Cl.
*F21S 13/14* (2006.01)

(52) U.S. Cl. ..... 362/252; 362/102; 362/145; 362/249; 362/253; 362/800; 135/91; 135/910

(58) Field of Classification Search ..... 362/102, 362/249, 252, 253, 800, 806, 145, 103, 108; 135/91, 910; 313/512
See application file for complete search history.

(56) References Cited

U.S. PATENT DOCUMENTS

| | | | | |
|---|---|---|---|---|
| 1,765,911 | A | 6/1930 | Fabianke | |
| 4,120,024 | A | 10/1978 | Aizenberg et al. | |
| 4,408,260 | A | 10/1983 | Miedel | |
| 4,582,062 | A | 4/1986 | Albini | |
| 4,599,682 | A | 7/1986 | Stephens | |
| 4,774,642 | A | 9/1988 | Janko et al. | |
| 5,178,453 | A | 1/1993 | Runels | |
| 5,954,417 | A * | 9/1999 | Mai | 362/102 |
| 6,116,752 | A * | 9/2000 | Mayfield et al. | 362/252 |
| 6,352,355 | B1 * | 3/2002 | Law | 362/253 |
| 6,382,825 | B1 | 5/2002 | Wainwright | |
| 6,773,140 | B2 | 8/2004 | Lee | |
| 2001/0004808 | A1 * | 6/2001 | Hurwitz | 36/137 |

* cited by examiner

*Primary Examiner*—Sandra L. O'Shea
*Assistant Examiner*—Meghan K. Dunwiddie
(74) *Attorney, Agent, or Firm*—Myers & Kaplan, LLP; Barry E. Kaplan, Esq.

(57) ABSTRACT

A lighted tent apparatus and system. The embodiments described herein typically include an inherent light source, advantageously incorporated into the textile elements of the structure, such as in the seams. In a typical embodiment, light emitting diodes having low power consumption are implemented.

18 Claims, 3 Drawing Sheets

LIGHTED TENT APPARATUS AND SYSTEM

Priority based on U.S. Provisional Patent Application Ser. No. 60/693,917, filed Jun. 27, 2005, and entitled, "Lighted Tent", is claimed.

BACKGROUND

I. Field of the Invention

The present invention relates generally to the field of tents and related structures, and more particularly to a lighted tent apparatus and system for use with textile elements to service as walls, doors, ceilings, and awnings.

II. Description of the Related Art.

Structures such as tents, canopies and gazebos are typically used as temporary shelters for a variety of purposes such as camping, social events and the like. Such temporary structures are desirable to have protection from UV rays, rain, wind insects and the like. However, these temporary structures typically do not include light sources. Often times, external light sources are brought into the structure. Alternatively, attempts have been made to incorporate an inherent light source, but such sources can be unmanageable and heavy. As such, there persists a need for a lightweight inherent light source for these structures.

SUMMARY

In general, the invention features a lighted tent apparatus and system. The embodiments described herein typically include an inherent light source, advantageously incorporated into the textile elements of the structure, such as in the seams. In a typical embodiment, light emitting diodes having low power consumption are implemented.

In general, in one aspect, the invention features a lighted structure apparatus, including a light string and a power box coupled to the light string.

In one implementation, the light string includes a fabric layer configuration, wires coupled to the power box and retained within the fabric layer configuration and light transducers electrically coupled to the wires.

In another implementation, the fabric layer configuration includes an inner fabric layer disposed between leads disposed on the light transducer, a first outer fabric layer and a second outer fabric layer, wherein the inner fabric layer is disposed between the first and second outer fabric layers.

In another implementation, at least one of the first and second fabric layers is a textile element of a structure.

In another implementation, the light transducer protrudes from the fabric layers.

In another implementation, the fabric layer configuration includes a first fabric layer and a second fabric layer coupled to the first outer fabric layer, wherein the first and second fabric layers are stitched at an apex point.

In another implementation, the light transducers are disposed between the first and second fabric layers In still another implementation, the fabric layer configuration comprises a single fabric layer curled toward itself thereby formed a channel.

In yet another implementation, the light transducers are disposed within the channel.

In another aspect, the invention features a lighted structure system, including a textile structure having seams, a plurality of light transducers incorporated into the seams and a power source for providing illumination to the plurality of light transducers.

In one implementation, the system further includes wire incorporated into the seams and coupled to the light transducers and to the power source.

In another implementation, the wire and plurality of light transducers are incorporated into a fabric configuration.

In another implementation, the fabric configuration includes an inner layer of fabric wherein a portion of the wire straddles with side of the inner layer of fabric and outer fabric layers flanking the inner fabric layer, wherein the fabric layers are affixed to one another at a common location.

In another implementation, the fabric configuration includes a first fabric layer and a second fabric layer stitched at a common point with the first fabric layer, wherein the wire and the plurality of light transducers are disposed between the fabric layers.

In another implementation, the fabric configuration comprises a textile element of the structure, curled upon itself thereby forming a channel therein.

In another implementation, the wire and the plurality of light transducers are disposed within the channel.

In another aspect, the invention features a lighted structure, including a series of textile elements forming a structure for temporary shelter, a plurality of light transducers and means for retaining the light transducers within the textile elements of the temporary shelter.

In one implementation, the plurality of light transducers is retained in seams between the textile elements.

One advantage of the invention is that it provides an inherent light source.

Another advantage of the invention is that it is not bulky and that it is lightweight.

Another advantage of the invention is that it has low power consumption.

Another advantage of the invention is that it implements a power switch having a power source such as a battery.

Another advantage of the invention is that is can implement manual power generators such as shake or crank power sources.

Other objects, advantages and capabilities of the invention are apparent from the following description taken in conjunction with the accompanying drawings showing the preferred embodiment of the invention.

DETAILED DESCRIPTION

Figure 1:
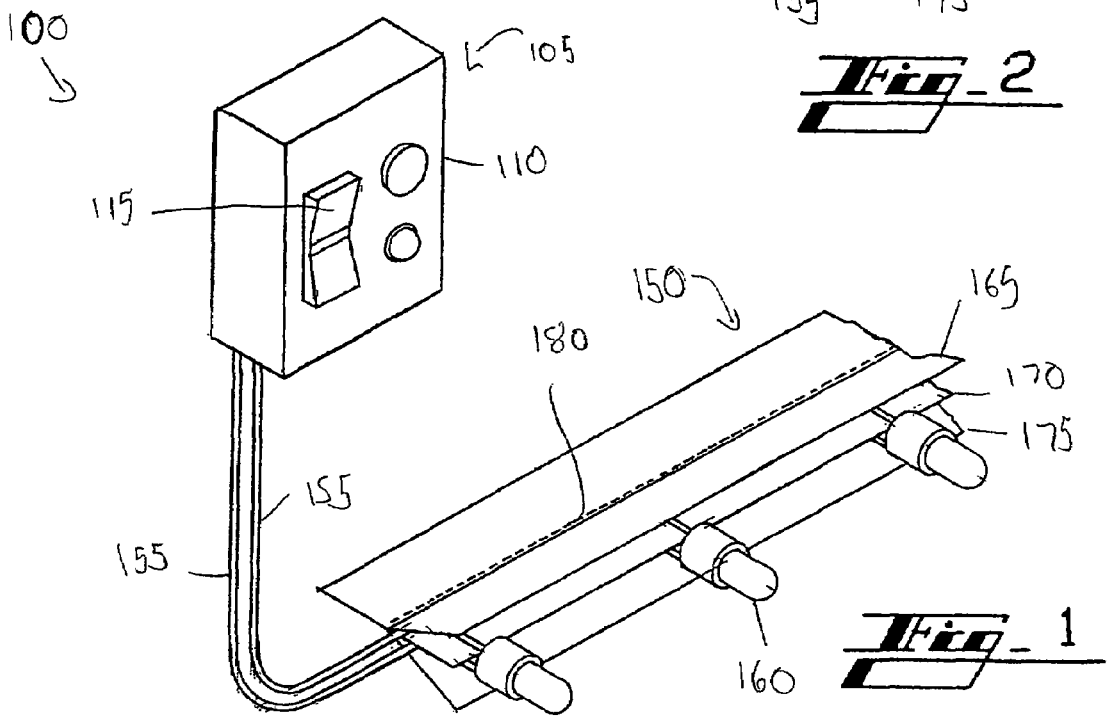
FIG. 1 illustrates a perspective view of an embodiment of a lighted structure lighting apparatus.

Referring to the drawings wherein like reference numerals designate corresponding parts throughout the several figures, reference is made first to FIG. 1 that illustrates a perspective view of an embodiment of a lighted structure lighting apparatus 100. In a typical embodiment, apparatus 100 includes switch housing 105 and light string 150. Switch housing 105 typically includes housing 110, switch 115 for supplying power to light string 150. Switch housing 110 can advantageously store batteries (not shown) for supplying power. In other embodiments, manual power generators such as shake or crank power sources can be implemented.

Figure 2:
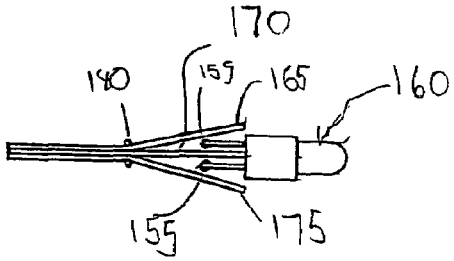
FIG. 2 illustrates a side view of an embodiment of a lighted structure lighting apparatus.

Light string 150 can hold wires 155 through which electricity for power travels. Light string 150 further includes light transducers 160 (typically light emitting diodes (LEDs)) for supplying light in the structure. In a typical embodiment, light string 150 can include layers 165, 170, 175 of fabric, which can be incorporated or part of a seam of the structure. Referring still to FIG. 1 and to FIG. 2 that illustrates a side view of an embodiment of a lighted structure lighting apparatus 100, layers 165, 170, 175 are sandwiched in layers such that middle layer 170 is flanked by light transducer leads 161, leads 161 connecting to wires 155. Outer layers 165, 175 can flank light transducers 160. In a typical implementation, one side of light string 150 can be stitched or otherwise integrated into a desired seam of the structure. The remaining side of light string 150 can enclose wires 155 and leads 161 as discussed. It is appreciated that layers 165, 170, 175 can be arranged and incorporated in several different orientations in addition to as discussed. It is further understood that any of fabric layers 165, 170, 175 can be seams or other textile elements of the structure. In the embodiments described herein, layers 165, 170, 175 can be advantageously sewn or otherwise affixed to one another. By way of example only, layers 165, 170, 175 can be coupled together via stitch 180.

Figure 3:
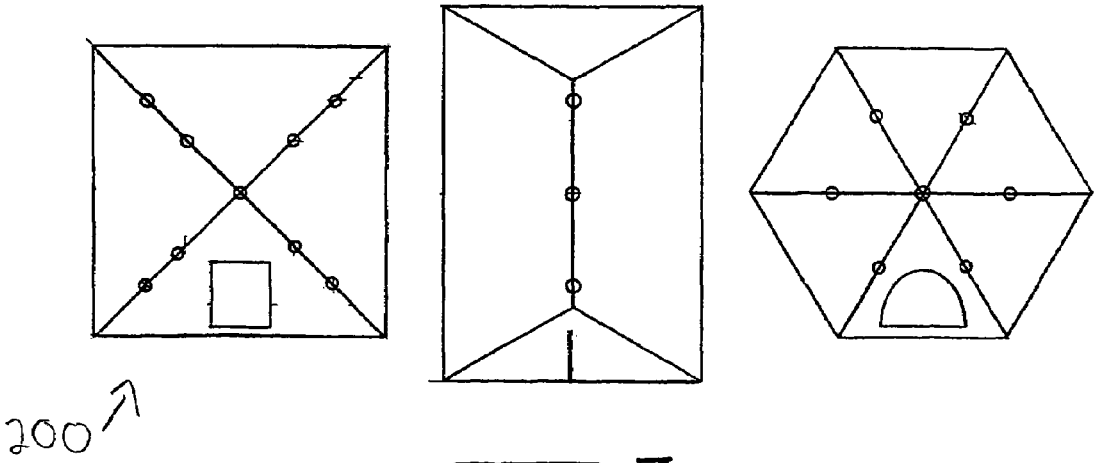
FIG. 3 illustrates top views of embodiments of lighted structures.

FIG. 3 illustrates top views of embodiments of lighted structures 200, illustrating various contemplated locations for the apparatuses 100. Such structures 200 incorporating apparatuses 100 can advantageously be a lighted structure kit or system.

Figure 5:
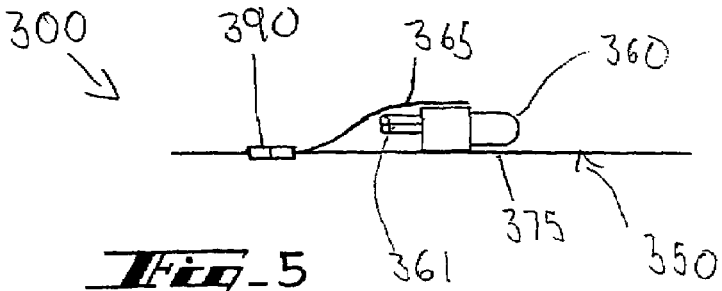
FIG. 5 illustrates a side view of an alternate embodiment of a lighted structure lighting apparatus.
Figure 4:
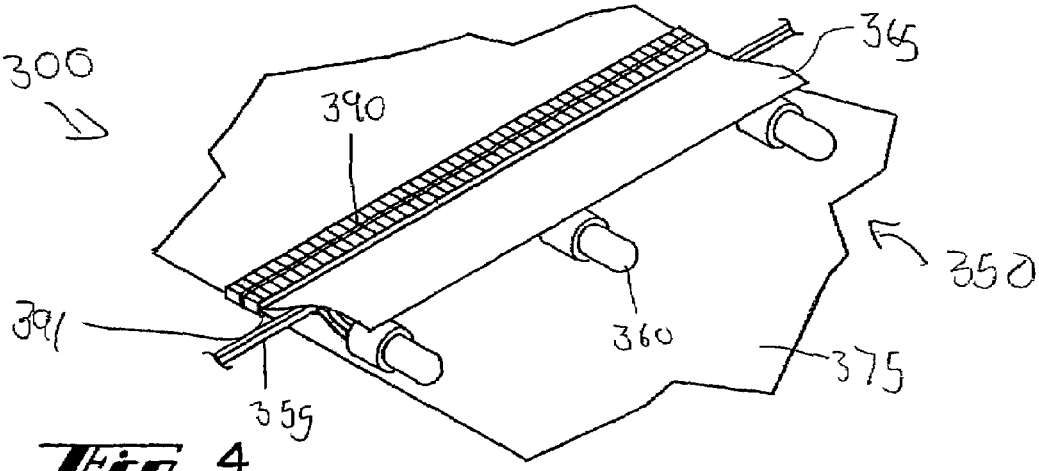
FIG. 4 illustrates a perspective view of an alternate embodiment of a lighted structure lighting apparatus.

FIG. 4 illustrates a perspective view of an alternate embodiment of a lighted structure lighting apparatus 300, and FIG. 5 illustrates a side view of an alternate embodiment of a lighted structure lighting apparatus 300. In a typical embodiment, apparatus 300 includes light transducer 360 having leads 361, similar to as described above. As shown, apparatus 300 can further include double fabric layer 350 having layers 365, 375, with light transducer 360 nested between layers 365, 375. In one embodiment, layer 375 can be a textile element such as a door or wall of a structure. Layer 365 can be an additional layer of fabric sewn onto layer 375. As illustrated, layers 365, 375 are adjacent zipper 390 of the structure. In the embodiment, double fabric layer 350 is adjacent an opening of the structure, thereby advantageously illuminating an entrance of the structure. It is appreciated that double fabric layer 350 is stitched directly into seam 191 of zipper 390. Similar as described above, leads 361 are connected to wires 355 that terminate in a switch (not shown).

Figure 6:
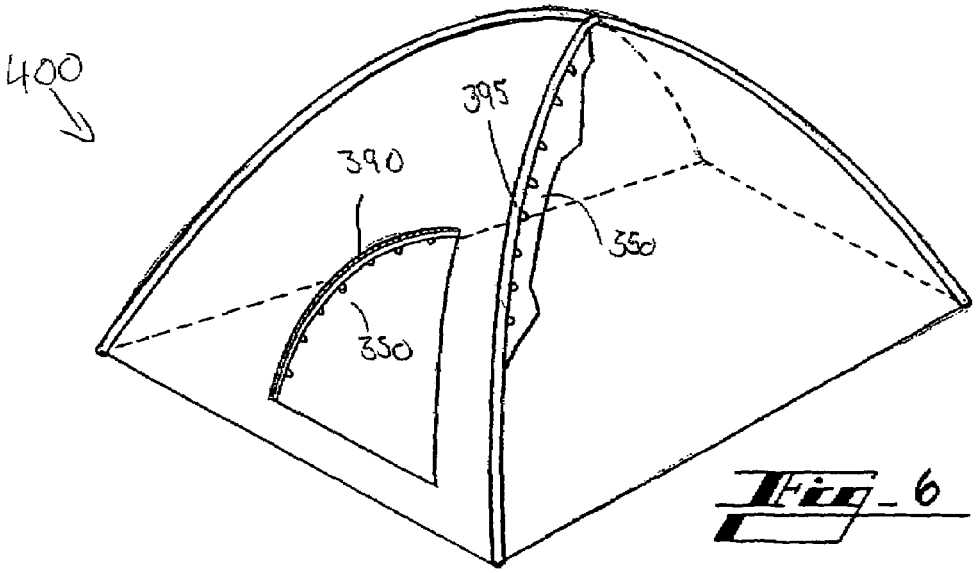
FIG. 6 illustrates a top perspective view of an embodiment of a light structure.

FIG. 6 illustrates a top perspective view of an embodiment of a light structure 400, illustrating double fabric layer 350 advantageously stitched into both seam 395 of structure 400 and adjacent zipper 390 of structure 400, as described above.

Figure 8:
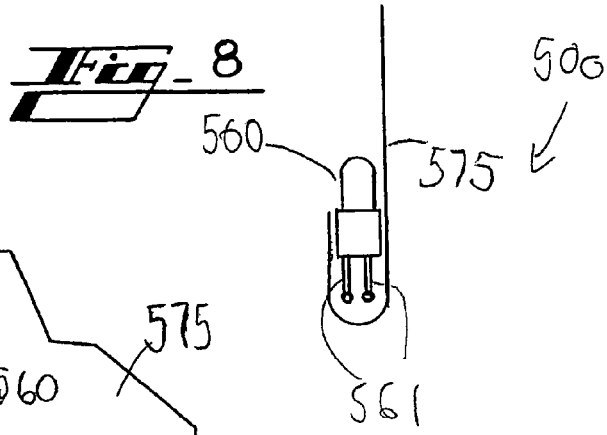
FIG. 8 illustrates a side view of another alternate embodiment of a lighted structure lighting apparatus.
Figure 7:
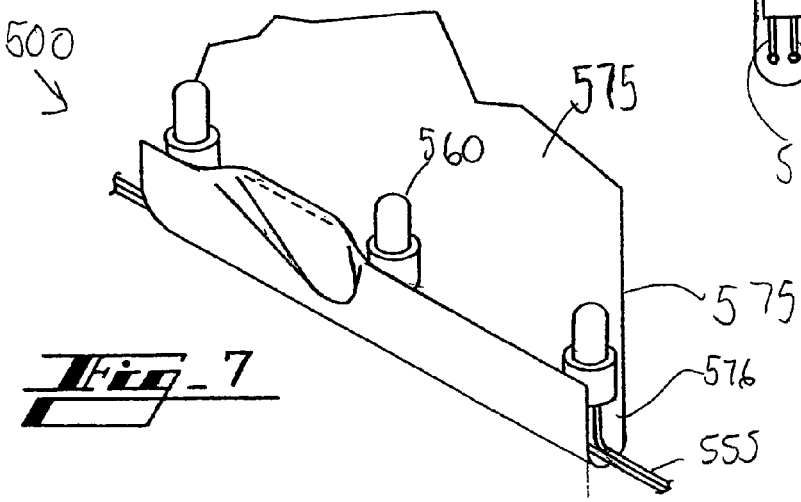
FIG. 7 illustrates a perspective view of another alternate embodiment of a lighted structure lighting apparatus.

FIG. 7 illustrates a perspective view of another alternate embodiment of a lighted structure lighting apparatus 500, and FIG. 8 illustrates a side view of another alternate embodiment of a lighted structure lighting apparatus 500. In a typical embodiment, apparatus 500 includes light transducer 560 having leads 561, similar to embodiments described herein. Typically, apparatus 500 can further include single fabric layer 575 curled upon itself to form channel 576. Light transducers 560 and wires 555 are therefore disposed within channel 576. Layer 575 can advantageously be rigid to retain channel 576. In a typical embodiment, layer 575 is a textile element such as a door or wall of a structure. Similar as described above, leads 561 are connected to wires 555 that terminate in a switch (not shown).

Figure 9:
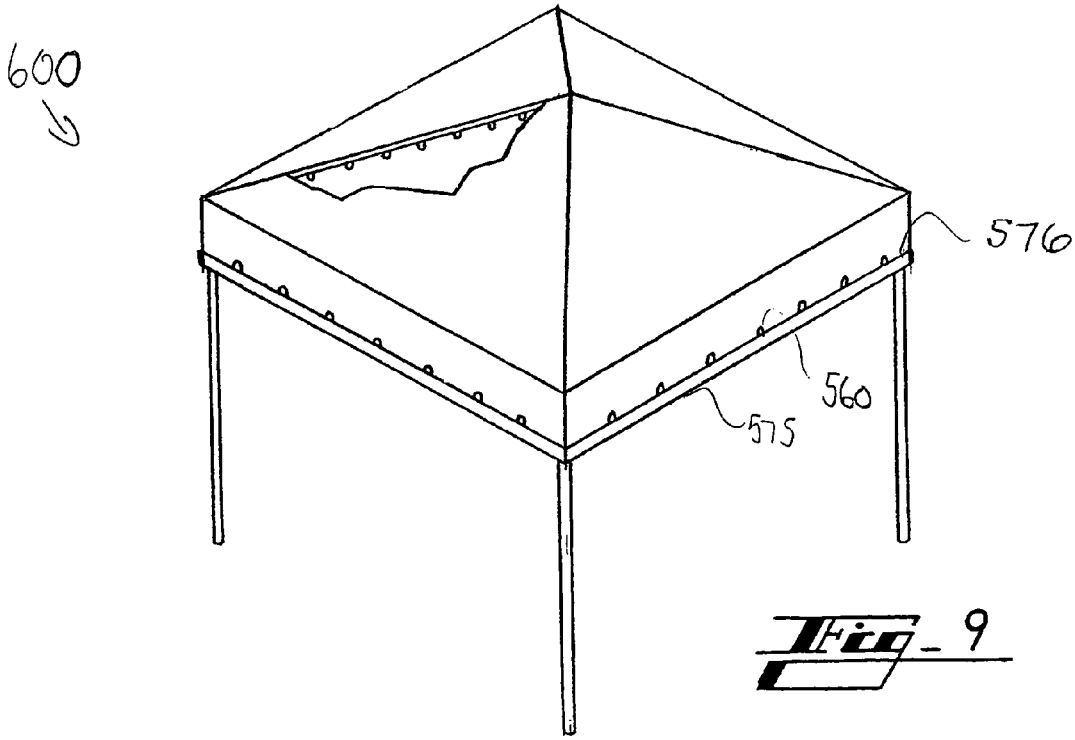
FIG. 9 illustrates a top perspective view of another embodiment of a light structure.

FIG. 9 illustrates a top perspective view of another embodiment of a light structure 600. As illustrated apparatuses 500 are incorporated around a perimeter of structure 500 and retained within channel 576 as described.

In the embodiments described herein, it is contemplated that the light strings and transducers can be put on dimmers, timers and the like. As such, in other embodiments, such features can either be manual or advantageously programmed into firmware with simple processor circuits. As such, the software techniques and methods discussed above can be implemented in digital electronic circuitry, or in computer hardware, firmware (as discussed), software, or in combinations of them. Apparatus may be implemented in a computer program product tangibly embodied in a machine-readable storage device for execution by a programmable processor; and methods may be performed by a programmable processor executing a program of instructions to perform functions by operating on input data and generating output. Further embodiments may advantageously be implemented in one or more computer programs that are executable on a programmable system including at least one programmable processor coupled to receive data and instructions from, and transmit data and instructions, to a data storage system, at least one input device, and at least one output device. Each computer program may be implemented in machine language or assembly language which can be assembled or translated, or a high level procedural or object-oriented programming language, which can be complied or interpreted. Suitable processors include, by way of example, both general and special purpose microprocessors. Generally, a processor receives instructions and data from read-only memory and or RAM. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing may be supplemented by, or incorporated in, specially designed application specific integrated circuits (ASICs).

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. An apparatus comprising:

a lighted structure, a light string comprising a fabric layer configuration including at least two layers and light transducers protruding from the fabric layer configuration; and a power box coupled to the light string, wherein the fabric layer configuration comprises a first fabric layer, and a second fabric layer coupled to the first fabric layer, wherein the first and second fabric layers are stitched at an apex point.

2. The apparatus as claimed in claim 1, wherein the light string further comprises wires electrically coupled to the light transducers, electrically coupled to the power box, and retained within the fabric layer configuration.

3. The apparatus as claimed in claim 1, wherein the fabric layer configuration comprises:

an inner fabric layer disposed between leads of the light transducers;

a first outer fabric layer; and a second outer fabric layer, wherein the inner fabric layer is disposed between the first and second outer fabric layers.

4. The apparatus as claimed in claim 3 wherein at least one of the first and second outer fabric layers is a textile element of a structure.

5. The apparatus as claimed in claim 1 wherein the light transducers are disposed between the first and second fabric layers.

6. The apparatus as claimed in claim 1, wherein the fabric layer configuration comprises a single fabric layer curled toward itself thereby forming a channel.

7. The apparatus as claimed in claim 6 wherein the light transducers are disposed within the channel.

8. A lighted shelter system having a structure, comprising:

a textile element defining the structure of the lighted shelter, the textile element having at least one seam;

a plurality of light transducers incorporated within the at least one seam; and a power source for providing illumination to the plurality of light transducers.

9. The system as claimed in claim 8, further comprising wire incorporated into the at least one seam and coupled to the light transducers and to the power source.

10. The system as claimed in claim 9, wherein the wire and plurality of light transducers are incorporated within the at least one seam via a fabric configuration.

11. The system as claimed in claim 10, wherein the fabric configuration comprises:

an inner layer of fabric wherein the plurality of light transducers straddle the inner layer of fabric; and outer fabric layers flanking the inner fabric layer, wherein the fabric layers are affixed to one another at a common location.

12. The system as claimed in claim 10, wherein the fabric configuration comprises:

a first fabric layer; and a second fabric layer stitched at a common point with the first fabric layer, wherein the wire and the plurality of light transducers are disposed between and protrude from the fabric layers.

13. The system as claimed in claim 10 wherein the fabric configuration comprises a textile element of the structure, curled upon itself thereby forming a channel therein.

14. The system as claimed in claim 13 wherein the wire and the plurality of light transducers are disposed within the channel.

15. A lighted tent, comprising:

a series of textile elements forming a structure for the tent;

a plurality of light transducers disposed about a periphery of an entrance into the tent; and means for retaining the light transducers within the textile elements of the tent.

16. The tent as claimed in claim 15, wherein the plurality of light transducers is retained in at least one seam of the textile elements.

17. The tent as claimed in claim 15, wherein the plurality of light transducers are retained within a seam of a zipper closure of the entrance.

18. The tent as claimed in claim 15, wherein the plurality of light transducers are retained within a channel, the channel comprising at least one of the textile elements folded upon itself.

* * * * *